US007434318B2

(12) United States Patent
Perez et al.

(10) Patent No.: US 7,434,318 B2
(45) Date of Patent: Oct. 14, 2008

(54) TOOL WITH ENLARGED HAMMER ELEMENT

(75) Inventors: Ricardo Perez, Hartford, CT (US); Jason Lind, Barkhamsted, CT (US); Matthew Earle Myers, Naperville, IL (US); Scott Fong, Jardines Bazaar (HK)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 11/187,582

(22) Filed: Jul. 22, 2005

(65) Prior Publication Data

US 2007/0017101 A1 Jan. 25, 2007

(51) Int. Cl.
*B26B 3/00* (2006.01)
*A47L 13/022* (2006.01)

(52) U.S. Cl. ..... 30/169; 30/167; 30/168; 16/430; 16/431; 16/902; 81/492; 7/105

(58) Field of Classification Search ..... 30/167, 30/168, 169; 16/430, 440, 441, 902, DIG. 12, 16/DIG. 18, DIG. 19; 294/57; 81/58, 126, 81/489, 492; 7/105; D8/14
See application file for complete search history.

(56) References Cited

U.S. PATENT DOCUMENTS 1,603,771 A * 10/1926 Hokanson ..... 30/167
D157,904 S 3/1950 Reusch
D206,517 S * 12/1966 Hans ..... D8/14
3,562,826 A * 2/1971 Vaughn ..... 7/105
3,971,094 A 7/1976 Solf et al.
4,091,497 A * 5/1978 Bade ..... 16/430
D282,716 S * 2/1986 Heinis et al. ..... D8/107
4,620,369 A * 11/1986 Gercken ..... 30/329
4,974,286 A * 12/1990 Stowell et al. ..... 16/421
D319,379 S 8/1991 Cummings et al.
5,063,627 A * 11/1991 Marra ..... 7/105
5,342,379 A * 8/1994 Volinsky ..... 606/167
5,390,572 A 2/1995 Gakhar et al.
5,615,445 A 4/1997 Kelsay et al.
5,730,662 A * 3/1998 Rens ..... 473/300
5,740,586 A * 4/1998 Gomas ..... 16/436
5,850,663 A 12/1998 Hardy et al.
5,956,799 A * 9/1999 Panaccione et al. ..... 15/236.01
6,128,808 A * 10/2000 Jansson et al. ..... 16/431
6,131,290 A * 10/2000 Chiou ..... 30/169
6,182,317 B1 * 2/2001 Huang ..... 7/105
D441,269 S 5/2001 Tsai
D446,104 S 8/2001 Chen
6,345,556 B1 * 2/2002 Lin ..... 81/177.1
6,418,820 B1 * 7/2002 Lamond et al. ..... 81/177.1
D462,251 S 9/2002 Collins et al.
RE38,093 E 4/2003 Chiou (Continued)

*Primary Examiner*—Boyer D. Ashley
*Assistant Examiner*—Edward Landrum
(74) *Attorney, Agent, or Firm*—Greer, Burns & Crain, Ltd.; David F. Janci, Esq.; Pradip Sahu, Esq.

(57) ABSTRACT

A tool includes a blade having a working edge and an attachment edge opposite the working edge, a handle with distal and proximal ends and a body having at least one diameter. The proximal end is associated with the attachment edge. A hammer element is associated with the distal end, and a periphery of the hammer element extends in a radial direction greater than the at least one diameter of the body.

19 Claims, 6 Drawing Sheets

U.S. PATENT DOCUMENTS 6,581,247 B1 * 6/2003 Yu Chen ..... 16/430
D483,244 S 12/2003 Chen
D483,638 S 12/2003 Jimenez
6,668,751 B1 12/2003 Henke
6,742,215 B2 * 6/2004 Panfili et al. ..... 15/236.01
6,749,790 B1 * 6/2004 Lieser et al. ..... 264/279
D498,124 S 11/2004 Mitchell
D500,600 S 1/2005 Hay et al.
2003/0084545 A1 5/2003 Cheng

* cited by examiner

TOOL WITH ENLARGED HAMMER ELEMENT

BACKGROUND OF THE INVENTION

The present invention generally relates to hand tools, and more particularly to a taping knife of the type used to finish drywall construction projects.

Taping knives or tools (the terms are considered interchangeable), which have varying blade widths, are used to finish drywall construction projects and create a smooth transition between abutting drywall surfaces. After drywall boards are in place, a smaller (e.g. 4-6 inch) taping knife is generally used to apply a settable joint compound and drywall tape to the joints formed by the abutting drywall surfaces. At this stage, unseated nails must also be finally set into the wallboards and supporting studs. After the joint compound dries, progressively larger (e.g. 8 inch-14 inch) knives are used to apply more compound to the joint areas. This step is repeated, with intermittent sanding steps, until the joint is sufficiently flat and smooth.

Present taping knives often use wood or plastics, such as glass-filled nylons or polyolefins for the handle. However, the low coefficient of friction on the smooth outer surface of conventional handles allows slippage of the knife in the user's hand, particularly when the hand becomes wet from perspiration or joint compound. Also, users with smaller hands have difficulty holding conventional taping knives during prolonged use.

While it is known to provide taping knives with a hammer element at the end of the handle for setting nails or other objects, many conventional knives do not have such hammer elements, and the knives that do typically have hammer elements that typically cap off the handle. Many of the workers that use conventional taping knives will set the nail prior to applying joint compound by striking the nail with the side of the handle perpendicular to the nail instead of striking the nail axially with respect to the handle as the tool is intended to be used. This improper use can cause the handle to crack, requiring the replacement of the knife. Also, it is not uncommon for users' hands to slip on the handle during the hammering operation and become pinched between the tool and the wall.

Consequently, there is a need in the home improvement and/or home-decorating industries for an improved taping knife with improved gripping characteristics and which address the above-identified drawbacks.

BRIEF SUMMARY OF THE INVENTION

The above-listed needs are met or exceeded by the present taping knife, which features an oversized hammer element attached to a lengthened handle shaft that holds the blade of the knife. The oversized hammer allows for greater ease of use for the end user given its relative size, providing more surface area to strike the drywall fastener, and a "baseball bat" type hammer shape that protrudes radially from the handle. This protrusion further acts as a buffer for the end user's hand when striking the wall, thus further reducing the possibility of pinching the hand. The taping knife also includes a handle made of inner and outer solid cores, with the outer core surrounding and interlocking with the inner core. The two solid cores are then covered with a resilient material for improved gripping characteristics and impact absorption.

The present handle also has a tapering neck allowing the end user to place his hand closer to the blade, thereby allowing greater control of the blade and its usage in the application of the joint compound to the wall and/or tape. This tapered neck is connected to a flared portion that tapers toward the blade at an angle that provides for a smooth transition, thereby also reducing the abrasion to the hand that can result from an abrupt transition from handle to blade, as found in conventional tools.

More specifically, the present taping knife includes a blade having a working edge and an attachment edge opposite the working edge, a handle with distal and proximal ends and a body having at least one diameter. The proximal end is associated with the attachment edge. A hammer element is associated with the distal end, and a periphery of the hammer element extends in a radial direction greater than the at least one diameter of the body.

In another embodiment, the present handle is configured for being provided with a plurality of blade designs, including a rectangular blade with a reinforcing backing plate of various widths, oval or semi-circular blade designs, and other less common blade designs as are known in the art.

DETAILED DESCRIPTION OF THE INVENTION

Figure 1:
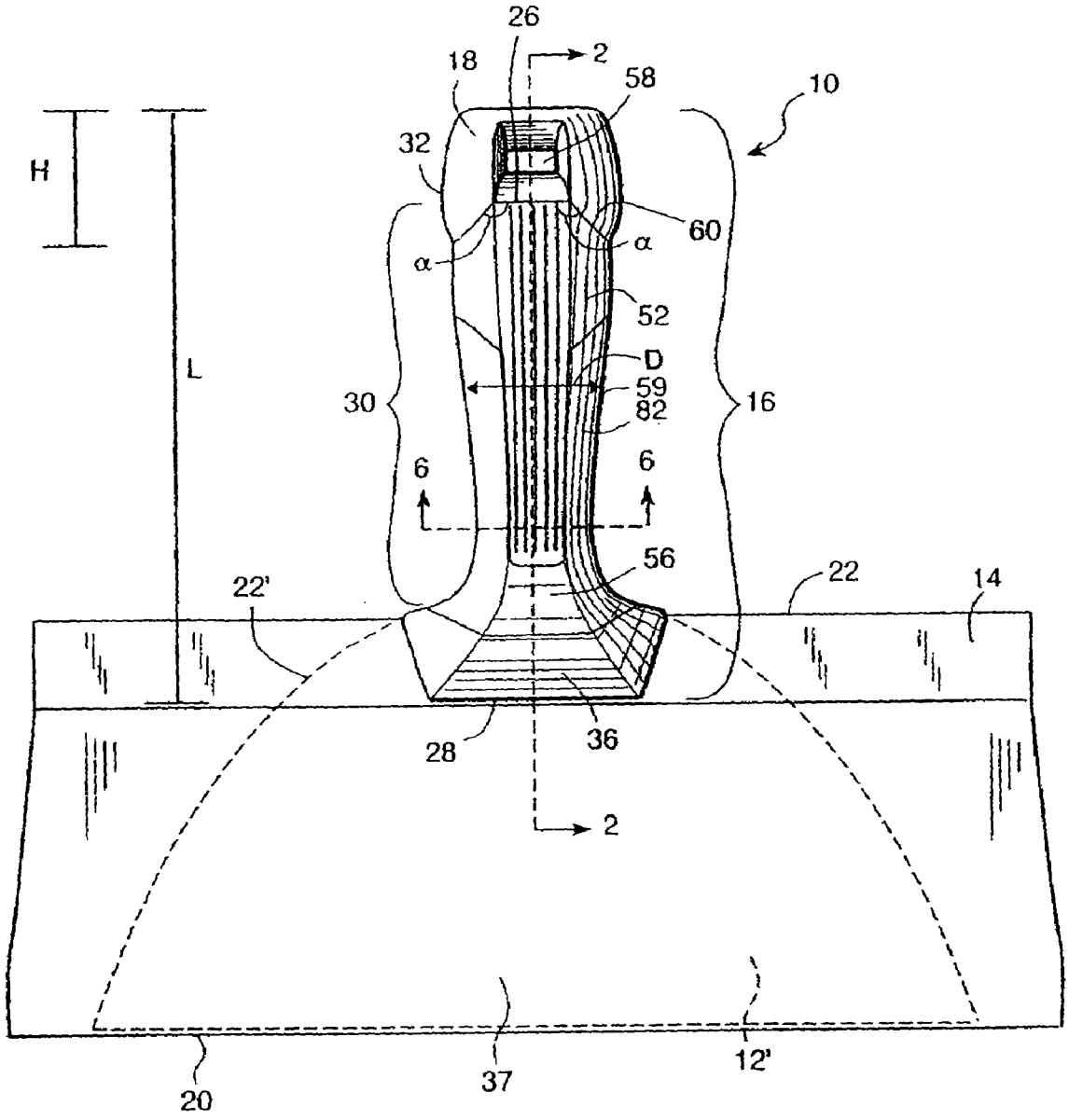
FIG. 1 is a front view of the present taping knife, with portions omitted for clarity.
Figure 5:
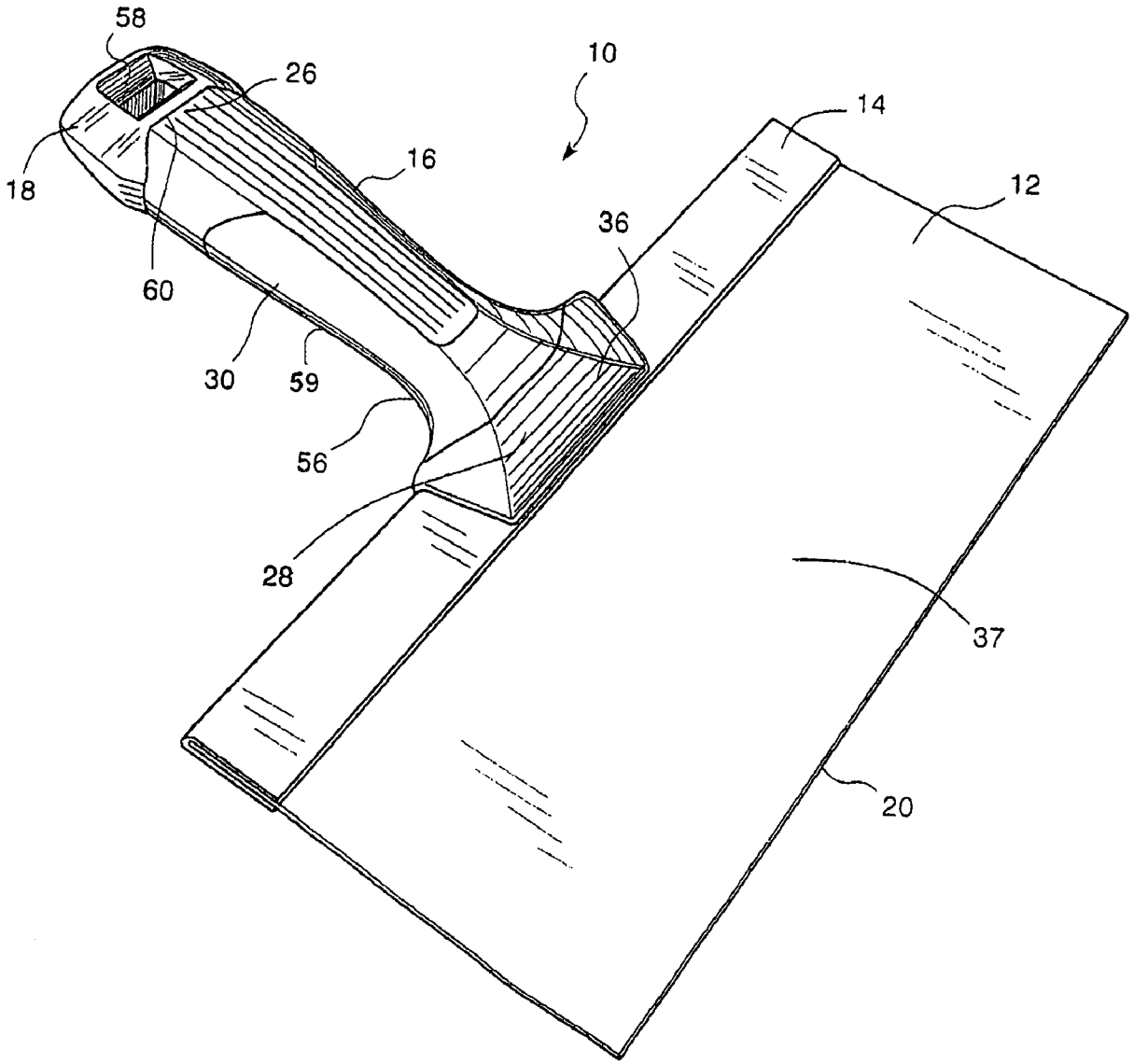
FIG. 5 is a top perspective view of the present taping knife.

Referring to FIGS. 1 and 5, a taping knife generally designated 10 is preferably constructed of a flat metal blade 12, a reinforcing backing plate 14, a handle 16, and a hammer element 18. The blade 12 has a working edge 20 and an attachment edge 22 opposite the working edge 20. While other materials are contemplated, the blade 12 is preferably made of blued steel and the reinforcing backing plate 14 of aluminum. The shape of the blade 12 is as shown in FIG. 1, but it is envisioned that the handle 16 is usable with shorter blades 12' having a curved attachment edge 22' (shown in phantom in FIG. 1), and lacking a reinforcing backing plate 14 as are well known in the art. Furthermore, other blade shapes are contemplated, either with or without a reinforcing backing plate 14.

The handle 16 has at least one diameter D and includes distal 26 and proximal ends 28 and a body 30, the proximal end 28 is associated with the attachment edge 22. A feature of the present knife 10 is the configuration of the hammer element 18, which is associated with the distal end 26 and is preferably but not necessarily made of a harder material relative to the handle 16. Here, "associated with" means that the hammer element 18 will be attached to the distal end 26. However, it is foreseeable that the hammer element 18 and the distal end 26 may not be in direct contact. The same applies to the proximal end 28.

A periphery 32 of the hammer element 18 extends in a radial direction greater than at least one diameter D of the handle body 30. This provides more surface area for striking the drywall fasteners or other hammering tasks performed by users such as tradesmen. In addition, the oversized hammer element 18 acts as a buffer for the end user's hand when striking the wall, reducing the possibility of pinching the hand. It should be noted that the "baseball bat"-type handle and hammer configuration may vary in size to suit the particular application.

The handle 16 described above and best seen in FIG. 1 may have at least one diameter D including a plurality of diameters of various sizes extending from the distal end 26 to the proximal end 28. An advantage of the preferred embodiment is that the largest diameter D of the plurality of diameters is smaller than the periphery 30 of the hammer element 18. The hammer element 18 is contemplated as being constructed of several different hard materials, the properties of which include strength, durability, and low malleability and ductility. It is envisioned that the preferred hammer element 18 is constructed of metal, preferably zinc.

As shown in FIG. 1, an axial length H of the hammer element 18 is most preferably 20-25 percent of an axial length L of the handle 16. However, the axial length H of the hammer element 18 is preferably in the approximate range of 15-30 percent of the axial length L of the handle 16.

Figure 6:
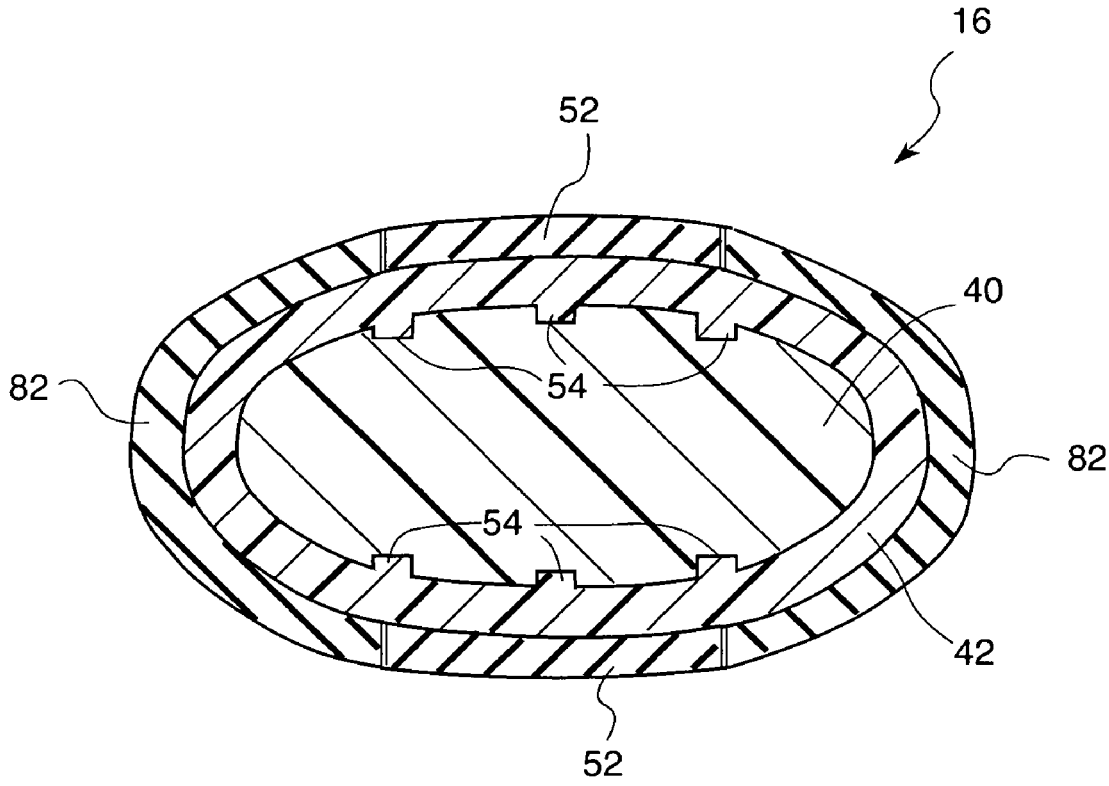
FIG. 6 is a cross-section taken along the line 6-6 shown in FIG. 1 in the direction generally indicated.

As shown in FIG. 6, the handle 16 has a generally elliptical cross-section for better handle comfort. The generally elliptical cross-section of the taping knife 10 preferably extends to a point directly adjacent the attachment edge 22 of the blade 12. This feature allows for placement of the hand closer to the blade 12 for greater control and use.

Figure 2:
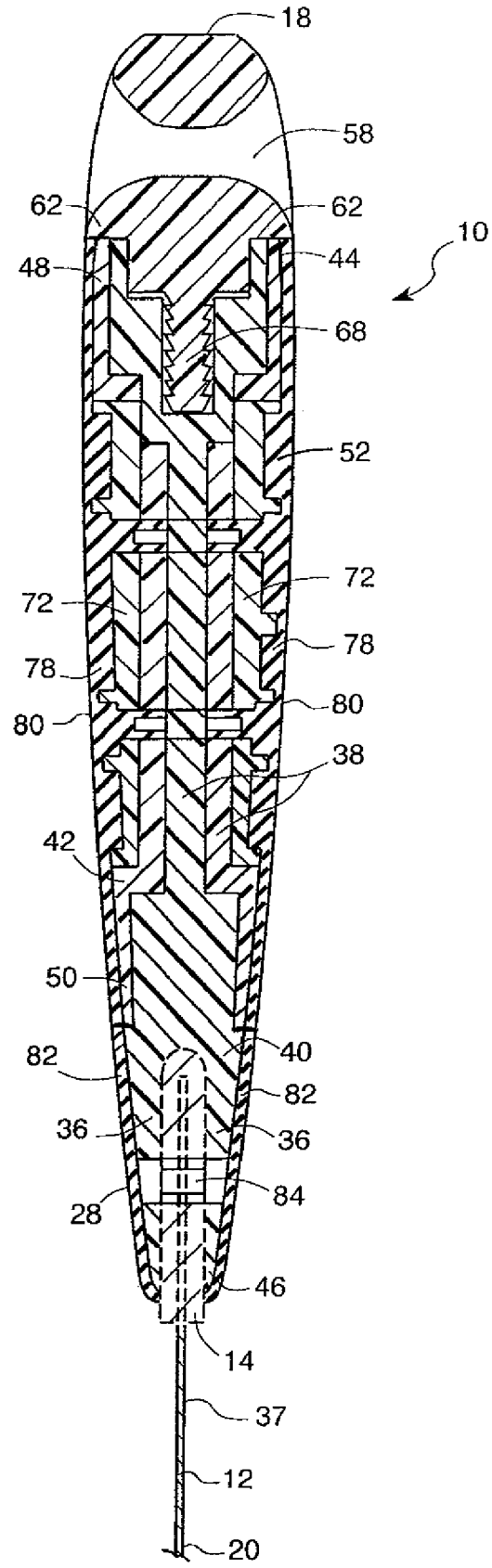
FIG. 2 is a cross-section taken along the line 2-2 shown in FIG. 1 in the direction generally indicated.
Figure 3:
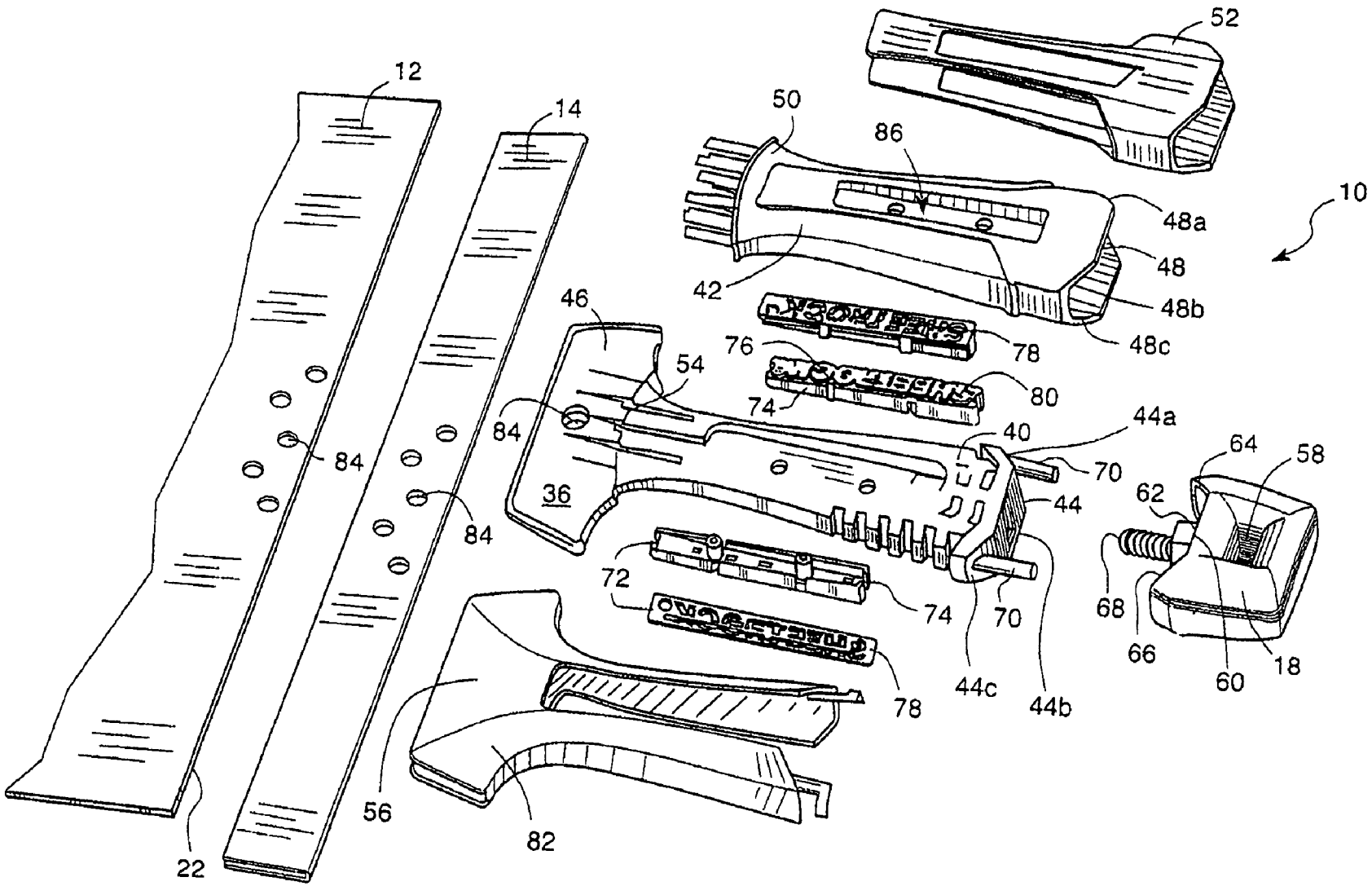
FIG. 3 is an exploded top perspective view of the present taping knife.

Referring now to FIGS. 1, 2, and 3, the proximal end 28 flares laterally greater than the width of the handle body 30. This configuration provides increased contact and support of the handle 16 with the blade 12, strengthening a failure point of traditional taping knives. As seen in FIG. 2, the proximal end 28 includes two lips 36 narrowing in thickness towards the working edge 20 of the blade 12. The lips 36 extend over the attachment edge 22, and over a portion of the backing plate 14, or, in narrower blades, over a web 37 of the blade 12.

The preferred embodiment includes a core 38 (seen in FIG. 2) made up of an inner core 40 and an outer core 42 (seen in FIG. 3). The inner core 40 has a distal end 44 and a proximal end 46. Likewise, the outer core 42 has a distal end 48 and a proximal end 50. While other conventional fabrication techniques are contemplated, the inner core 40 is preferably made by injection molding. The outer core 42 is preferably integrally formed by overmolding over the inner core 40, and a resilient gripping region 52 is integrally formed by overmolding over the outer core 42. The technique of overmolding is well known in the art. It is contemplated that the inner core 40 has a plurality of recess formations 54 for receiving the outer core 42 to increase the strength of the bond between them. Both the inner core 40 and the outer core 42 may be made of polypropylene for its strength, cost, and workability attributes. Other equivalent materials known to skilled practitioners are contemplated. The gripping region 52 may be made of Santoprene brand styrene-ethylene-butylene-styrene or other moldable, resilient, rubber-like materials known in the art.

Furthermore, the resilient gripping region 52 is preferably textured, as by corrugations or ribs for improved gripping characteristics, and may be provided in more than one portion. The textured surface prevents slippage when the hand becomes wet from perspiration or other liquids.

As shown in FIG. 1, the handle body 30 increases in diameter from the proximal end 28 to the distal end 26. In addition, the proximal end 28 flares laterally outward from a neck 56 of the handle 16 for providing support to the blade and also for providing additional gripping surface to the user. The hammer element 18 also has a relatively large eyelet 58 allowing the taping knife 10 to be hung up on a tool rack, hook, or other projection when not in use or to suspend the tool after use to facilitate drying.

The hammer element 18 abuts the distal end 26. A feature of the present knife 10 is that the hammer element 18 has portions that interlock with the distal end 26 allowing greater protection to the handle, especially when the user employs the side of the handle and hammer element as an impact tool, such as to set unseated nails. In the preferred embodiment, the hammer element 18 abuts the distal end 26 at at least one obtuse angle $\alpha$ relative to the extremity of the distal end 26 for dispersing impact forces in the lateral as well as axial directions. In addition, the angular design also protects a side 59 of the handle 16 farther down the length of the handle when compared to a non-angular design.

In the preferred embodiment a lower edge 60 (shown in FIG. 3) of the hammer element 18 has three segments (shown in FIG. 4), a central segment 62 is generally perpendicular to a longitudinal axis of the handle, and two end segments 64, 66, each defining the angle $\alpha$ with the center segment 62. In the preferred embodiment, $\alpha$ is approximately 135 degrees, however other angles are contemplated. As seen in FIG. 3, the distal ends 44 and 48 are provided with corresponding opposing surfaces 44*a-c* and 48*a-c* to positively engage the above-identified angled configuration of the lower edge 60 of the hammer element 18.

Figure 4:
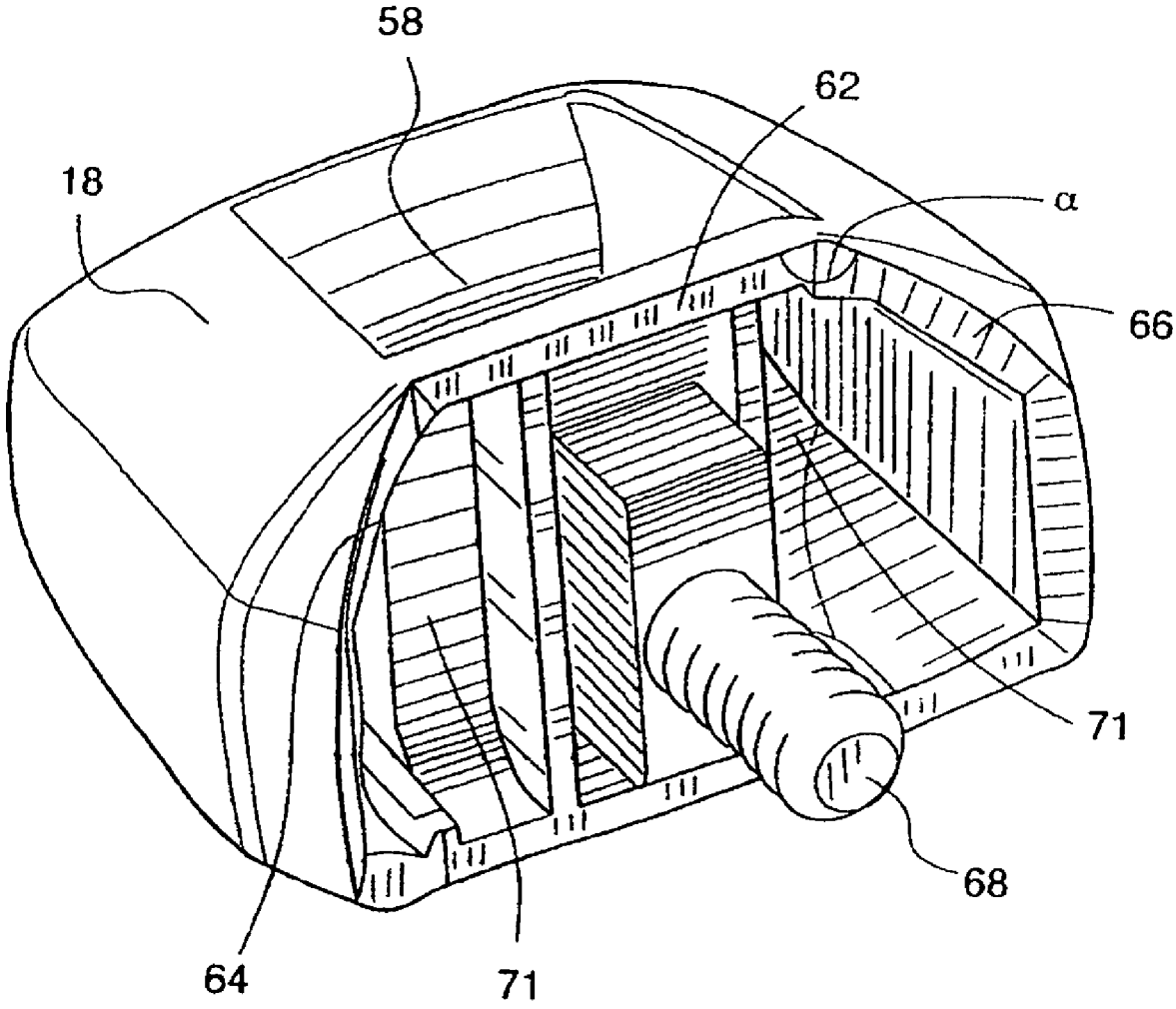
FIG. 4 is a top perspective view of the hammer element.

Referring now to FIGS. 3 and 4, the hammer element 18 is provided with at least one barbed peg 68 for attaching the hammer element 18 to the inner core 40. The barbs on the peg 68 securely retain the hammer element in a corresponding bore (not shown) in the core 40 and prevent the hammer element 18 from becoming severed from the inner core 40 upon impact. Also, the inner core 40 includes at least one and preferably two unbarbed lugs 70 extending from the distal end 44 of the inner core 40. The two unbarbed lugs 70 mate with corresponding holes 71 in the hammer element 18 and prevent the hammer element from rotating about the single barbed peg 68.

Referring now to FIG. 3, another feature of the present taping knife 10 is that the handle 16 is configurable so that the user will be able to identify the source manufacturer even after long-term use. Accordingly, the handle 16 has an insert 72 including a relatively hard portion 74 having a raised logo 76 and a resilient portion 78 surrounding the raised logo 76. The resilient portion 78 may be made of a rubber-like material as described in relation to the gripping region 52 upon assembly and is flush with an upper surface 80 of the logo. Constructing the logo 76 out of a relatively hard material allows the logo 76 to last longer and, since it is made of integrally formed plastic rather than being painted or printed on the handle 16, makes the logo 76 resistant to rubbing or wearing off during use. Consequently, users will be able to associate the tool with its manufacturer for a longer period of time than conventional taping knives.

In addition, the resilient portion 78 surrounding the logo 76 provides comfort to the user's hand when holding the taping knife 10. Surrounding the hard portion 74 with the resilient rubber-like portion 78 is more comfortable than if the insert 72 was made entirely of a hard material. The resilient portion 78 may be made of Santoprene brand styrene-ethylene-butylene-styrene and the hard portion 74 of polypropylene. Those skilled in the art are familiar with equivalent alternatives for the above-identified materials.

Upon assembly, the attachment edge 22 is inserted into the reinforcing backing plate 14, then crimped and/or fastened in place. Next, the blade 12 is placed in a mold and the inner core 40 is formed, preferably by injection molding, however other production techniques are contemplated. During molding, the proximal end 46 of the inner core 40 flows over the reinforcing backing plate 14 and the attachment edge 22, securing these parts together without the use of rivets or other fasteners. This flowing plastic also prevents the seepage of moisture between the plastic handle 16 and the metal blade 12, which is known to cause failure in conventional taping knives. The preferred embodiment eliminates the need for rivets.

The inner core 40 and the blade 12 are then placed together in a mold and the outer core 42 is similarly formed, as by injection molding over the inner core 40. After that, a resilient material 82 is provided and formed over the outer core 42 to provide a soft gripping surface for the user. Santoprene brand styrene-ethylene-butylene-styrene or other moldable rubber-like materials may be used for the resilient material 82. The resilient material 82 is also preferably used to facilitate the attachment of the inner core 40 to the blade 12 and optionally the reinforcing backing plate 14. While the resilient material 82 may be provided in one step to cover the outer core 42, in the preferred embodiment the next step in the assembly process is to inject the resilient gripping region 52 as seen in FIG. 3. This gripping region 52 is applied over the outer core 42 and interlocks with the resilient material 82.

The insert 72 is assembled by forming the relatively hard portion 74 having the logo 76, and then the resilient portion 78 is formed around it, preferably by overmolding. The insert 72 is then secured into the insert receiving area 86, such as with chemical adhesives, ultrasonic bonding or similar technologies (FIG. 3). Lastly, the hammer element 18 is fastened to the distal end 26 of the handle 16 and is secured by insertion of the barbed peg 68.

While a particular embodiment of the present taping knife with enlarged hammer end has been described herein, it will be appreciated by those skilled in the art that changes and modifications may be made thereto without departing from the invention in its broader aspects and as set forth in the following claims.

The invention claimed is:

1. A tool, comprising:

a blade having a working edge and an attachment edge opposite the working edge, said blade defining a plane;

a handle with distal and proximal ends and a body distinct from said proximal end having a generally elliptical shaped cross section and at least one diameter, said proximal end associated with said attachment edge, said handle including at least an inner core and an outer core disposed over at least a portion of said inner core, said inner core connected to said blade;

a hammer element secured to said handle inner core and associated with said handle distal end, said hammer element including an external lower edge abutting an outer surface of said outer core and defined by a central segment that is generally perpendicular to a longitudinal axis of said handle, and two end segments depending from said central segment that each define an obtuse angle with said outer surface of said outer core for dispersing impact forces acting on said hammer element in at least one of a lateral and an axial direction, and a periphery of said hammer element extending in a radial direction that is generally parallel to said blade plane and that is greater than said at least one diameter of said body, a portion of said periphery having a discontinuous, angled shape; and a first resilient material and a second resilient material each covering at least a portion of said outer core surface, an end of the first resilient material being configured to mate with an end of said second resilient material, said hammer element external lower edge abutting an outer surface of said second resilient material such that said end segments each define an externally visible obtuse angle with said second resilient material outer surface, said second resilient material outer surface configured for being gripped by a user during tool use;

wherein said hammer element provides a protective formation for a user's hand when gripping the tool about an adjacent, relatively smaller diameter portion of said body, said hammer element also having end and side impact surfaces for selectively dispersing impact forces in said lateral and axial directions.

2. The tool of claim 1 wherein said at least one diameter includes a plurality of diameters of various sizes extending from said distal end to said proximal end, a largest diameter of said plurality of diameters being smaller than said periphery of said hammer element.

3. The taping knife of claim 1 wherein an axial length of said hammer element is in the approximate range of 20-25 percent of an axial length of said handle.

4. The tool of claim 1 wherein said handle has a generally elliptical cross-section directly adjacent said attachment edge of the blade.

5. The tool of claim 1 wherein said proximal end flares laterally greater than said periphery of said hammer element.

6. The tool of claim 1 wherein said proximal end includes two lips narrowing in thickness progressing from said proximal end to said working edge of the blade.

7. The tool of claim 1 wherein said second resilient material is corrugated or ribbed for improved gripping characteristics.

8. The tool of claim 1 wherein the tool further comprises a reinforcing plate covering a portion of said blade attachment edge, said inner core and said first resilient material each covering a portion of said reinforcing plate.

9. The tool of claim 1 wherein said handle body increases in diameter from said proximal end to said distal end.

10. The tool of claim 1 wherein said hammer element abuts said distal end, and has portions interlocking with said distal end for providing greater protection to said handle.

11. The tool of claim 1 wherein said hammer element has generally rectangular shaped opposing sides parallel to said blade plane and through which an eyelet extends, said generally rectangular shaped opposing sides including said lower edge abutting said outer surfaces of said outer core and said second resilient material.

12. The tool of claim 1 wherein said handle has an insert including a relatively hard portion having a raised logo and a resilient portion surrounding said raised logo and being flush with an upper surface of said logo.

13. The tool of claim 1 wherein said hammer element is made of a harder material relative to said handle.

14. A tool as defined by claim 1 wherein said handle distal end has a plurality of lugs configured to prevent rotation of said hammer element relative to said handle, and wherein said hammer element has a corresponding plurality of holes configured to receive said plurality of lugs.

15. A tool as defined by claim 1 wherein said hammer element has at least one barbed peg, wherein said handle inner core is configured to engagingly receive said at least one barbed peg.

16. A tool as defined by claim 1 wherein said hammer element further includes a barbed peg extending from an angular step, said handle inner core configured to receive said barbed peg and said angular step, said angular step configured to increase engagement surface area between said hammer element and said handle inner core.

17. A tool, comprising:

a blade having a working edge and an attachment edge opposite the working edge, said blade defining a blade plane;

a handle with distal and proximal ends and a body having at least one diameter, said proximal end associated with said attachment edge, said handle having a generally elliptical shaped cross section and an inner core that is connected to said blade and at least partially covered by an outer core;

a hammer element made of a harder material relative to said handle, associated with said distal end and secured to said inner core, said hammer element including a first pair of opposing sides arranged generally perpendicular to said blade plane, and a second pair of opposing sides arranged generally perpendicular to said blade plane, an eyelet extending through said first pair of opposing sides, said first pair of opposing sides further including an external lower edge extending past said eyelet toward said handle proximal end and abutting an outer surface of said outer core at said handle distal end, said lower edge defined by a central segment that is generally perpendicular to a longitudinal axis of said handle, and two end segments depending from said central segment that each include three facets and define an externally visible obtuse angle with both said central segment and said outer surface of said outer core for dispersing impact forces in at least one of lateral and axial directions, said hammer element including a periphery formed by said first and second pairs of opposing sides, said periphery having a discontinuous, angled shaped formed by said lower edge;

a first resilient material and a second resilient material each covering at least a portion of said outer core outer surface, an end of said first resilient material being configured to mate with an end of said second resilient material, said hammer element external lower edge abutting an outer surface of said second resilient material such that said end segments each define an externally visible obtuse angle with said second resilient material outer surface, said second resilient material outer surface configured for being gripped by a user during tool use;

said handle having a generally elliptical cross-section directly adjacent said attachment edge; and said proximal end flares laterally greater than said periphery of said hammer element and extends over a portion of said blade;

wherein said hammer element provides a protective formation for a user when gripping the tool about an adjacent, relatively smaller diameter of said body, said protective formation having end and side impact surfaces for selectively dispersing impact forces in said lateral and said axial direction.

18. A tool as defined by claim 17 wherein said hammer element has at least one barbed peg, wherein said handle is configured to receive said at least one barbed peg, wherein said hammer element has at least two holes, one each on opposite sides of said at least one barbed peg, and wherein said handle distal end has a plurality of non-barbed lugs configured to be received by said plurality of holes and to resist rotation of said hammer element relative to said handle.

19. A tool, comprising:

a blade having a working edge and an attachment edge opposite the working edge and defining a plane;

a handle with distal and proximal ends and a body having at least one diameter, said proximal end secured to said attachment edge, said handle including at least an inner core connected to said blade, a relatively rigid outer core covering at least a portion of said inner core, and a first resilient material and a second resilient material each covering at least a portion of said outer core, an end of the first resilient material being configured to mate with an end of said second resilient material;

a hammer element made of a hard material relative to said handle, being associated with said distal end, and a periphery of said hammer element extending in a radial direction along said blade plane greater than said at least one diameter of said body for providing a protective formation for a user's hand grasping an adjacent relatively smaller diameter portion of said body; an axial length of said hammer element being in the approximate range of 15-30 percent of an axial length of said handle for providing a striking surface on an end and sides of said hammer element, said hammer element having a plurality of holes and a barbed peg configured to be received by said handle inner core, said hammer element having a plurality of holes and a barbed peg configured to be received by said handle inner core, said hammer element having a non-circular cross-section defined by a first pair of opposing sides arranged generally parallel to said blade plane and each defining a central segment, and a second pair of opposing sides arranged generally perpendicular to said blade plane, said second pair of opposing sides each including an end segment that depends from said central segment and includes three facets, said hammer element abuts corresponding outer surfaces of said outer core and said second resilient material at said handle distal end to form at least one externally visible obtuse angle relative to said distal end for dispersing impact forces acting on said hammer element in at least one of lateral and axial directions, said at least one obtuse angle being defined on said first pair of opposing sides, said first and second pair of opposing sides forming a periphery, wherein a portion of said periphery has a discontinuous, angled shape;

said handle having a generally elliptical cross-section adjacent said attachment edge;

a plurality of lugs on said handle inner core and configured to be received in said hammer element holes and configured to resist rotation of said hammer element relative to said handle, said lugs and said barbed peg being linearly aligned with each other to form a common plane; and said second resilient material being textured for improved gripping characteristics.

* * * * *